US009038851B2

(12) United States Patent
Picard et al.

(10) Patent No.: US 9,038,851 B2
(45) Date of Patent: May 26, 2015

(54) COVER FOR CONTAINER

(75) Inventors: Brad Anthony Picard, Foster, RI (US); Elie Helou, Jr., Carpinteria, CA (US)

(73) Assignee: CHAMNESS BIODEGRADABLES, LLL, Carpinteria, CA (US)

( * ) Notice: Subject to any disclaimer, the term of this patent is extended or adjusted under 35 U.S.C. 154(b) by 56 days.

(21) Appl. No.: 13/050,693

(22) Filed: Mar. 17, 2011

(65) Prior Publication Data

US 2012/0234850 A1 Sep. 20, 2012

(51) Int. Cl.
*B65D 43/16* (2006.01)

(52) U.S. Cl.
CPC .... *B65D 43/162* (2013.01); *B65D 2543/00027* (2013.01); *B65D 2543/00092* (2013.01); *B65D 2543/00222* (2013.01); *B65D 2543/00296* (2013.01); *B65D 2543/00361* (2013.01); *B65D 2543/0062* (2013.01); *B65D 2543/00703* (2013.01); *B65D 2543/00731* (2013.01); *B65D 2543/00814* (2013.01); *B65D 2543/00842* (2013.01)

(58) Field of Classification Search
CPC ..... B65D 43/162; B65D 2543/00296; B65D 2543/00027
USPC ..... 220/833, 837, 839, 254.1, 254.3, 254.4, 220/315, 810
See application file for complete search history.

(56) References Cited

U.S. PATENT DOCUMENTS

2009/0223966 A1 * 9/2009 Kidd et al. ..... 220/324

FOREIGN PATENT DOCUMENTS

GB 2133394 * 7/1984 ..... B65D 53/00

* cited by examiner

*Primary Examiner* — Fenn Mathew
*Assistant Examiner* — Elizabeth Volz
(74) *Attorney, Agent, or Firm* — Perkins Coie LLP; Joseph P. Hamilton; Yingli Wang

(57) ABSTRACT

A cover for a pie pan or similar type of pan or plate has a ring and a lid pivotally attached to the ring by a flex joint. A pan is placed into the ring with a lip of the pan resting on top of the ring. The cover is folded over and pressed down onto the ring. Interlocking elements on tabs on the ring and lid engage each other and hold the lid down onto the ring, with the lip of the pan between them. The lid may include inwardly projecting teeth spaced apart on an inside surface of the lid, with the teeth adapted to hold the lip of a pan between the ring and the lid.

17 Claims, 5 Drawing Sheets

COVER FOR CONTAINER

BACKGROUND

The field of the invention generally relates to containers.

Clear plastic and other clamshell food containers are widely used to hold various types of foods in retail stores, and also to hold carry out food from restaurants. While these containers work well in many applications, disadvantages remain when multiple types of materials are used. Accordingly, it is an object of the invention to provide an improved container and cover.

SUMMARY

In a first aspect of one embodiment, a pan or plate cover includes a ring and a lid pivotally attached to the ring by a flex joint. Tabs with interlocking elements may be provided on the ring and on the lid, to hold them together. The ring has an inside diameter selected to fit around and under a lip on a pan or plate. Inwardly projecting protrusions are spaced apart on an inside surface of the lid, with the protrusions adapted to hold a lip of the pan or plate between the ring and the lid. This allows the plate to be made of various materials that are susceptible to changing dimensionally based on moisture or temperature of the ambient environment while plastic covers would be relatively less susceptible to dimensional changes in the same environment. The cover, in combination with the pan or plate, can accordingly provide a convenient food container. Other and further objects and advantages will become apparent from the following detailed description, which is intended to provide an example, and which should not be taken in the sense of limiting the invention.

BRIEF DESCRIPTION OF THE DRAWINGS

In the drawings, the same reference number indicates the same element in each of the views.

DETAILED DESCRIPTION

Figure 1:
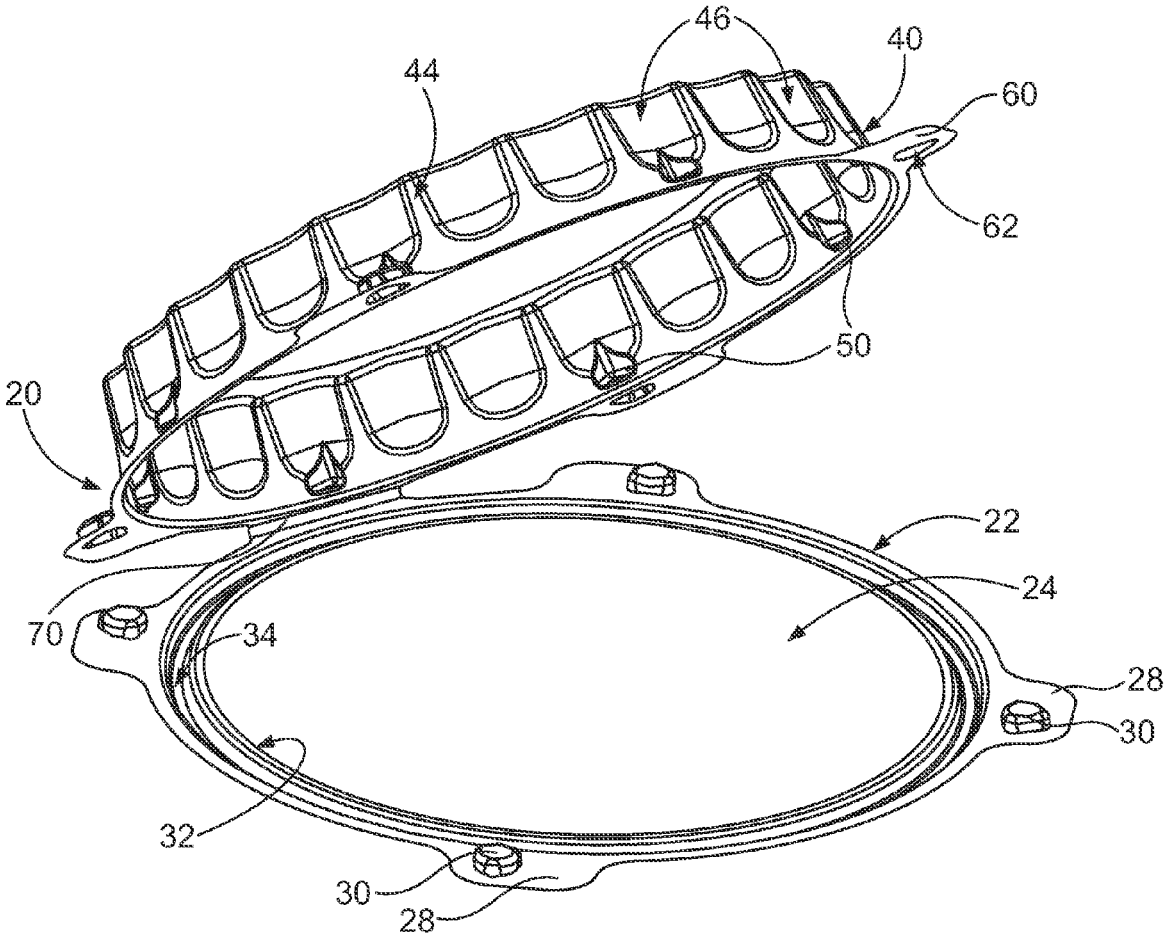
FIG. 1 is a perspective view of a novel food container cover.
Figure 2:
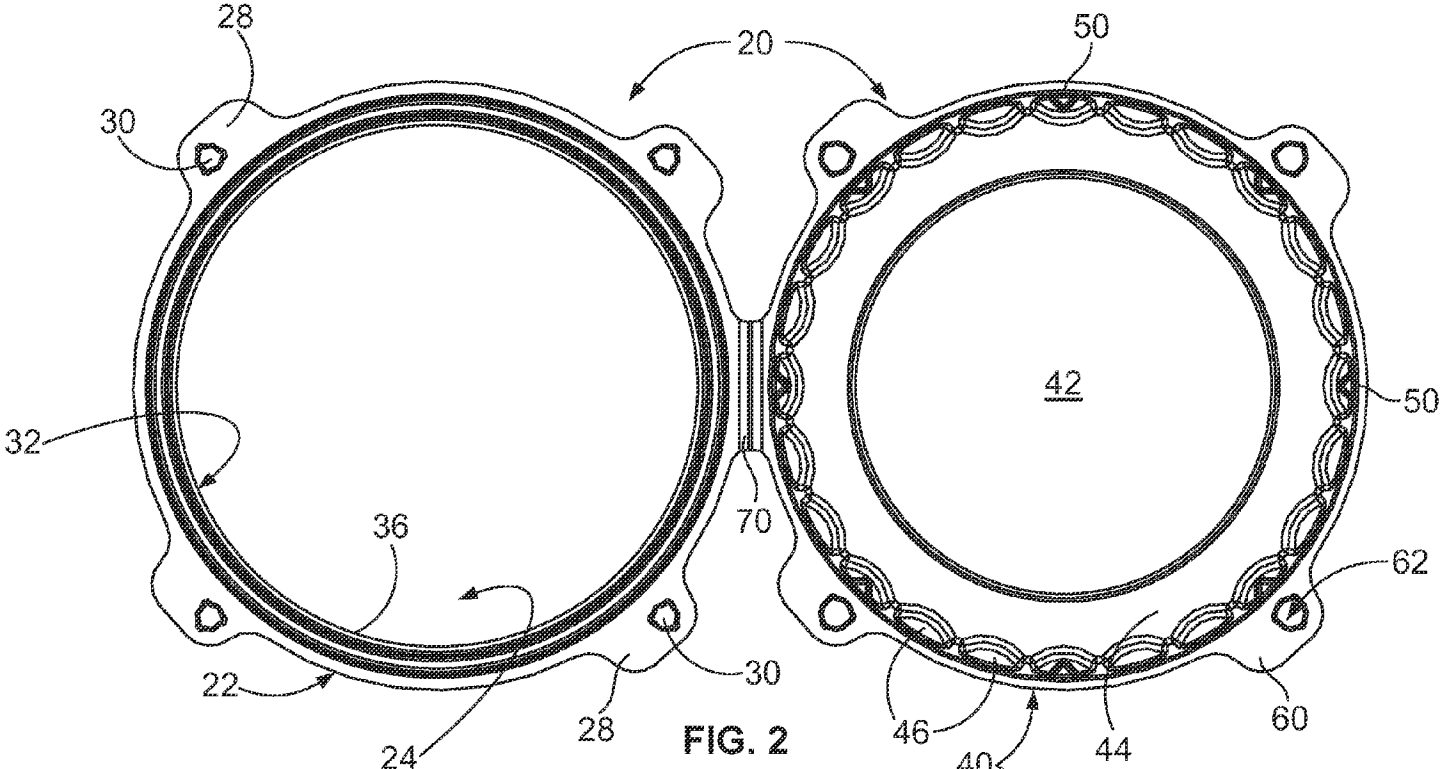
FIG. 2 is a top view of the cover shown in FIG. 1, with cover open or unfolded.
Figure 3:
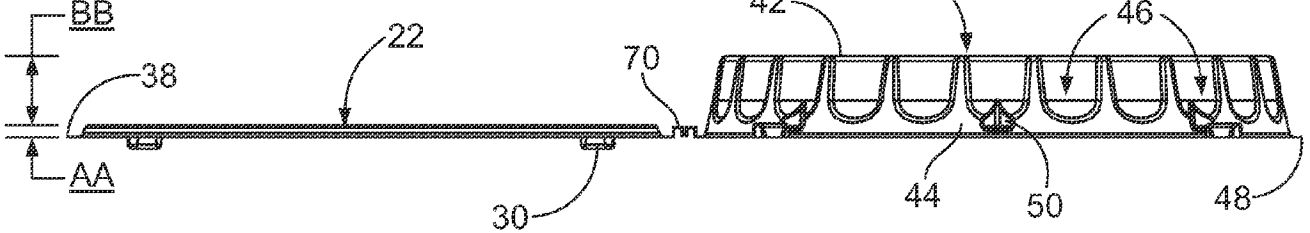
FIG. 3 is a side view of the cover as shown in FIG. 2.

As shown in FIGS. 1-3, a cover 20 has a base in the shape of ring 22 attached to a lid 40 via a hinge or flex joint 70. The ring 22 has a central through opening 24 with an inner diameter 32 selected based on the pan or plate that the cover 20 is used with. Ring tabs 28 on the ring 22 have a projection 30 adapted to engage with a corresponding receptacle or socket

62 on lid tabs 60 on the lid 40. When engaged into each other, typically with a snap fit, the projections 30 and sockets 62 provide ring and lid interlocking elements, respectively, which hold the lid 40 into a closed position on the ring 22. Of course the positions of the projections and sockets 62 may be reversed. The projections 30 and sockets 62 may be disengaged to open the cover 20 by pulling the tabs 28 and 60 apart. It is understood that other known connectors or methods to hold the lid 40 and ring 22 releasably together can be substituted for the tabs 28 with projections 30 and sockets 62. These connectors or methods can be single use connections such that once opened they cannot be reconnected, or multiuse connections such that cover can be selectively opened and closed.

Referring still to FIGS. 1-3, the top surface 42 of the lid 40, and a lid lip 48 are joined to a sidewall 44. The top surface 42 may be flat or domed. The sidewall 44 is typically cylindrical or slightly conical, with or without a pattern of indentations 46 to aid in stacking or for aesthetics. Discrete protrusions 50, are spaced apart about the inner circumference of the sidewall 44, optionally centered within an indentation 46, and projecting radially if a circular pattern or around discrete areas of the perimeter if a non-circular pattern inwardly.

Figure 4:
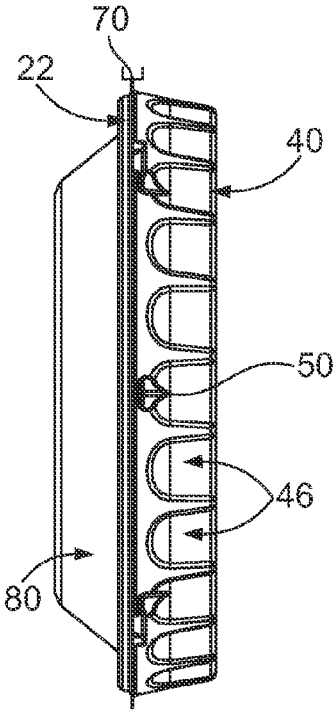
FIG. 4 is a side view of the cover shown in FIG. 1, with the cover placed onto a pan, and with the cover closed.
Figure 5:
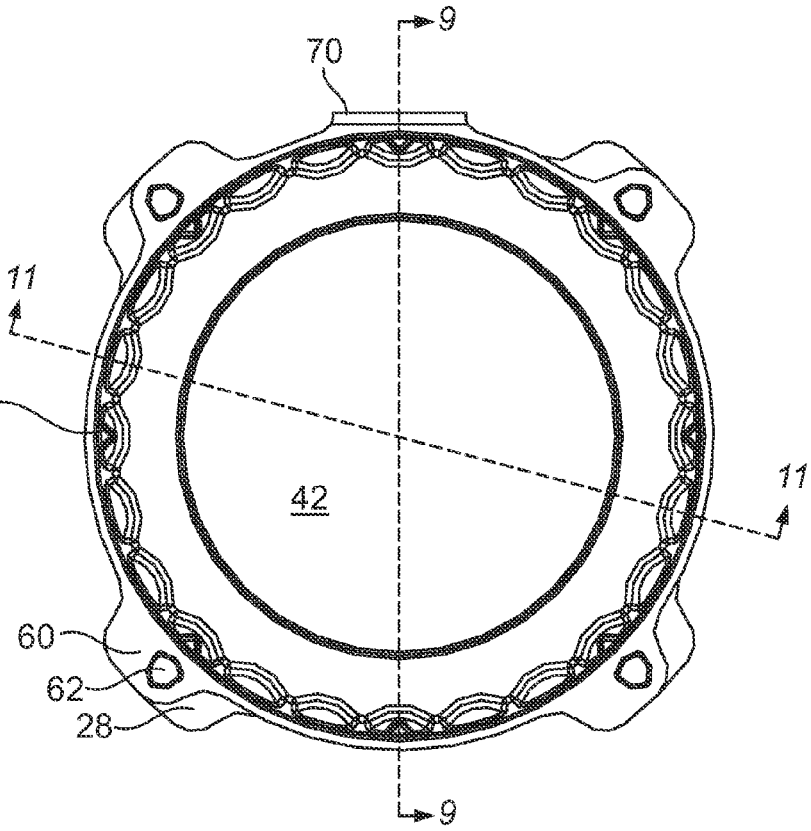
FIG. 5 it a top view of the cover as shown in FIG. 4.
Figure 6:
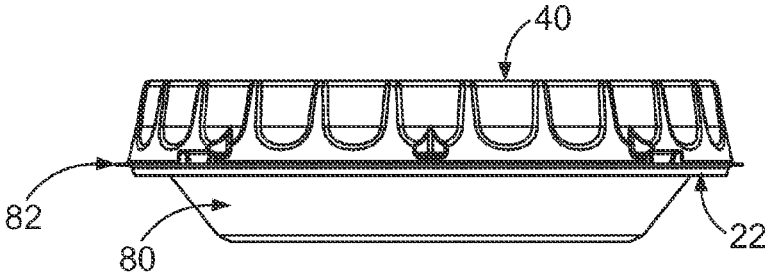
FIG. 6 is a side view of the cover as shown in FIGS. 4 and 5.
Figure 9:
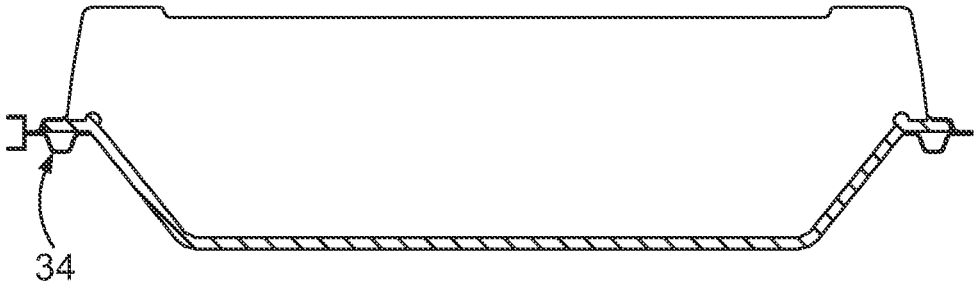
FIG. 9 is a section view taken along line 9-9 of FIG. 5.
Figure 10:
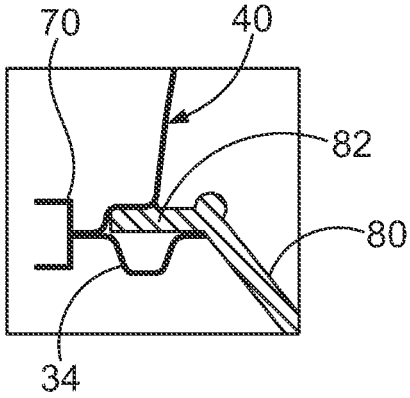
FIG. 10 is an enlarged detail view of the hinge and groove shown in FIG. 9.
Figure 11:
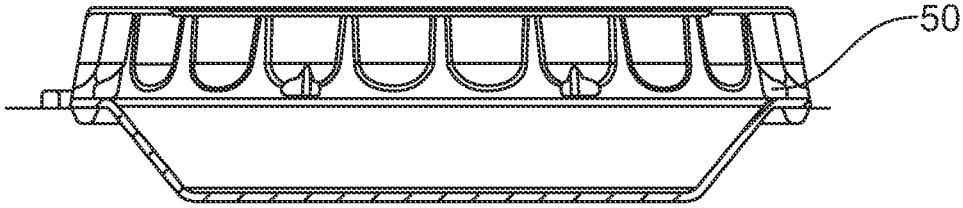
FIG. 11 is a reduced scale section view taken along line 11-11 of FIG. 5.
Figure 12:
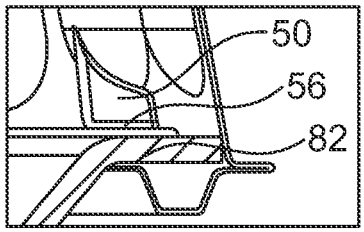
FIG. 12 is an enlarged detail view of the protrusion shown in FIG. 11.

Turning to FIGS. 4-6, the cover 20 is dimensioned to fit over and onto a container or other holder, such as a pie plate 80. The plate 80 is placed into the ring 22 with the cover 20 in the open position as shown in FIGS. 1-3. A lip 82 of the plate 80 extends radially outwardly over an optional channel 34 formed around the perimeter of the ring 22, as shown in FIGS. 9 and 10. The inside diameter 32 of the ring opening 24 is positioned under the plate lip 82, generally centering the plate 80 within the ring 22. The lid is then folded down from the open position shown in FIGS. 1-3 to the closed position shown in FIGS. 4-11 to form an inner cavity. As this occurs, a down-facing surface 56 on substantially each protrusion, best shown in FIGS. 8 and 12, moves into contact with the top surface of the plate lip 82. The projection 30 and socket 62 engagement features, or similar elements, snap together to hold the container into the closed position around the plate 80.

Figure 7:
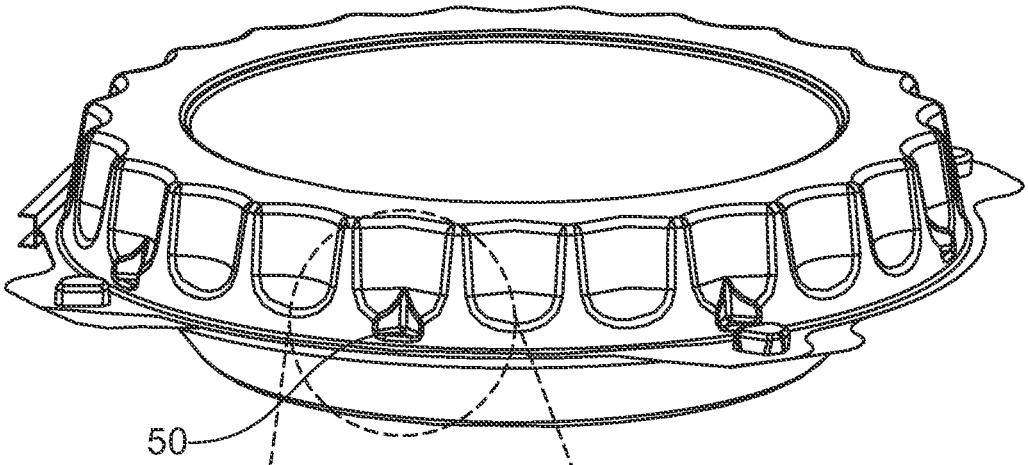
FIG. 7 is a top and front perspective view of the cover as shown in FIGS. 4-6.
Figure 8:
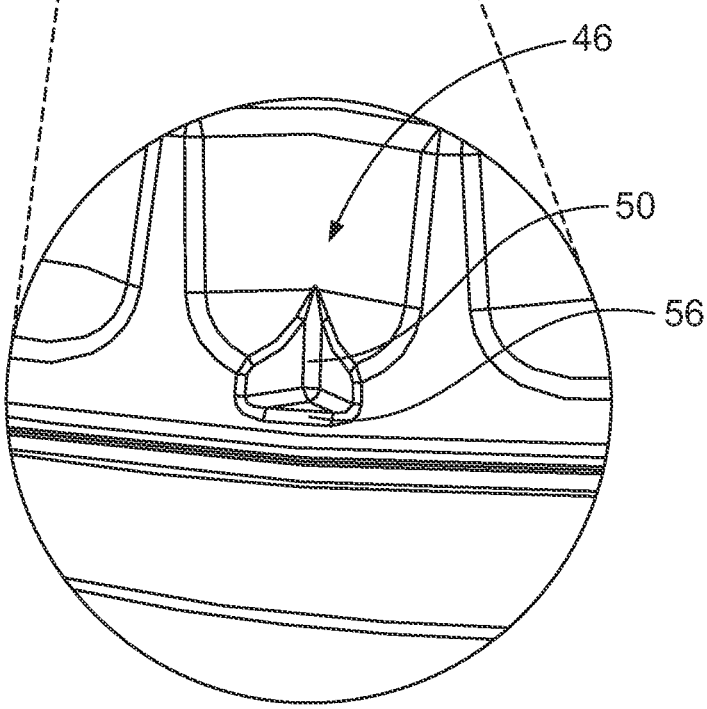
FIG. 8 is an enlarged detail view of a protrusion as shown in FIG. 7.

The down-facing surface 56 of the protrusion 50 may include an inclined area or ramp, as shown in FIGS. 7 and 8. In this design, as the lid moves down, the lip 82 of the plate may be centered within the cover. Each protrusion may also be better positioned to exert at least nominal holding force in the horizontal plane on the plate lip 82 when the cover is closed, regardless of tolerance variations in the plate lip 82 and the lid 40. The protrusions also trap the plate flange, or lip, between the upper cover and the lower ring. In this manner protrusion substantially restrains the plate from vertical and horizontal movement or shifting, while at the same time allows the cover 20 to accommodate plates with variations is size from contraction or expansion of the plate due to environmental or other conditions. The protrusions 50 can be positioned at selected locations around the perimeter of the cover 20 so that they can be used to restrain the movement of the plate but still allow space for a material to protrude over the edge of the plate, for example, a pie crust or similar. In some embodiments the protrusion 50 can contact the crust or similar to indicate cut locations for a user. In other embodiments the protrusion 50 can be arranged differently, for example, to extend around the inner perimeter of the cover 20, either continuously, semi-continuously or at various selected locations. Another embodiment would have a continuous bottom instead of just a ring.

As shown in FIGS. 9 and 10, the plate lip 82 is clamped between the ring 22 and the lid 40, radially inwardly from any of the projections 30. The cover 20 accordingly can properly fit onto the plate 80 even with significant variations (e.g., +/−5 mm) in the outer diameter of the plate ring 82. Variations in the thickness of the plate lip 82 are accommodated by the extent of engagement of the projections 30 and extension or flexing of the flex joint 70 and/or the degree of contact between the plate and the protrusion 50. In addition, overall dimensional changes in the plate due to moisture absorption or moisture loss can be easily accommodated in the horizontal plane. Hence changes in the dimensions of the plate due to changes in temperature, absorption of liquids, manufacturing tolerances, etc. are readily accommodated by the cover 20.

For example, environmentally friendly plates, such as plates made of starch, may expand considerably with increasing temperature. The cover 20 is suitable for use with these types of plates because the cover is unaffected by nominal changes in the dimensions of the plate. The cover, made of plastic in one embodiment, has relatively low or no expansion due to moisture absorption and/or drying out. While a container made from molded pulp or other packaging materials such as starch based trays tend to have relatively large expansion and contraction rates based on the moisture content of the trays, such that the trays absorb moisture or dry out depending on environmental conditions and can be dimensionally different at different ambient or storage conditions. Thus, the cover 20 according to some embodiments, allows the mating of cover that does not expand or contract and container that does. In addition, the protrusion 50 allow the cover to secure the item to be held and at the same time reducing the dimensions of the lid because, in these embodiments, the lid does not need to extend beyond the outer edge of the plate or similar.

The cover 20 including the annular ring 22, the lid 40 and the flex joint 70 may comprise an integral molded transparent plastic unit having a wall thickness ranging from 0.2 to 1.0 mm. The inside diameter 32 of the central opening 24 of the ring 22 may typically range from 10 to 30 cm, for use with common pie plates and similar pans. The ring 22 may have an outer diameter 1-4 cm greater than the inner diameter of the ring, excluding the ring tabs (i.e., a ring width of 1-4 cm). The diameter 32 of the central opening 24 of the ring 22 is typically about 80-95% or more of the total diameter of the ring. The height of the lid may be 4-10 times greater than the height of the ring, to reduce contact between the underside of the lid 40 and the contents of the pan 80. Although a round cover 20 is shown and described, the cover may of course have other shapes as well, such as oval or elliptical, hexagonal, octagonal, etc., as may be desired to match the shape of the pan 80.

In one variation, the base may be extended to completely or partially enclose the food container or other holder, such as a pie plate or similar, to be covered by the lid such that the combination of the lid and the extended base forms a clam shell or a partial clam shell to fully or partially enclose the food container or other holder. In another variation, the base may be formed separately from the lid such that hinge or flex joint 70 is not needed, and the base and lid are held together by projection 30 and socket 62 engagement features or similar only. In another variation, the base can be fused to the lid to form the hinge. In yet another variation the base can be formed from distinct components and fused or otherwise connected to reduce the material necessary to form the cover.

In another variation, the cover, may be in any shape, for example, square, rectangular, oval, triangular, star or other, to match the dimensions of the food container or other holder to be covered.

Thus, a novel cover has been shown and described. Various changes and substitutions can of course be made without departing from the spirit and scope of the invention. The invention, therefore, should not be limited except by the following claims and their equivalents.

The invention claimed is:

1. A cover comprising:

a base and a lid pivotally attached to the base by a flex joint to form an inner surface;

a plurality of base tabs on the base and a plurality of lid tabs on the lid;

a plurality of inwardly projecting protrusions spaced apart on the inside surface of the lid, with the protrusions adapted to hold a lip of a container between the base and the lid but allow expansion or contraction of the container;

with substantially each of the base tabs having a base interlocking element and with substantially each of the lid tabs having a lid interlocking element, and with each base interlocking element adapted to releasably interlock with a corresponding lid interlocking element;

wherein the base has a central through opening and the diameter of the central through opening is about 80-95% or more of the total diameter of the base.

2. The cover of claim 1, wherein the protrusions comprise teeth.

3. The cover of claim 2 with the lid having a top surface joined to an upper end of an upright sidewall and with the lid lip joined to a lower end of the upright sidewall, and further including indentations in the upright sidewall, and with each of the teeth located substantially at a center of an indentation.

4. The cover of claim 1 with the base, the lid and the flex joint comprising an integral molded transparent plastic unit having a wall thickness ranging from 0.2 to 2.0 mm, and wherein the base is an annular ring having an inside diameter ranging from about 2.5 to 55 cm.

5. The cover of claim 1, wherein the base is a ring having an outer diameter of about 0.5 to 5 cm greater than the inner diameter of the ring, excluding the base tabs.

6. The cover of claim 5 with the central through opening in the ring having a diameter more than 4 times greater than the radial width of the ring.

7. The cover of claim 5 with the lid having a height at least 3 times greater than the height of the ring.

8. A container system comprising:

a container; and a cover having:

a base and a lid pivotally attached to the base by a flex joint; a plurality of base tabs on the base and a plurality of lid tabs on the lid; with substantially each of the base tabs having a base interlocking element and with substantially each of the lid tabs having a lid interlocking element; a plurality of inwardly projecting teeth spaced apart on an inside surface of the lid, with the teeth adapted to hold a lip of the container between the base and the lid;

wherein the base has a central through opening and the diameter of the central through opening is about 80-95% or more of the total diameter of the base.

9. The container system of claim 8 with the interlocking elements generally on a diameter at least 1 mm greater than the diameter of the container lip, to allow the plate to expand without interfering with the attachment of the cover.

10. The container system of claim 8 with the container comprising starch.

11. The container system of claim 8 with the container comprising a pie plate having conical side walls.

12. The container system of claim 11 with the container lip having a thickness of about 0.15 mm to 5.2 mm.

13. A cover for use with a container, the cover comprising:

a base having a perimeter;

a lid having a perimeter that substantially corresponds to the perimeter of the base, and an inner and an outer surface, wherein the lid is releasably attachable to the base at the perimeter of the lid and base to substantially enclose an open portion of a container when the base is attached to the lid;

a plurality of protrusions on the inner surface of the lid, the protrusions configured to substantially hold the container between the base and the lid but allow expansion or contraction of the container;

wherein the base has a central through opening and the diameter of the central through opening is about 80-95% or more of the total diameter of the base.

14. The cover of claim 13, wherein the plurality of protrusions contact the container on a lip of the container and substantially extend about the perimeter of the container.

15. The cover of claim 13, wherein the plurality of protrusions contact the container on a lip of the container at discrete locations about the perimeter of the container.

16. The cover of claim 13, wherein when lid is attached to the base, the lid and base in combination substantially enclose the container.

17. The cover of claim 13, wherein when lid is attached to the base, the lid and base in combination substantially enclose an open portion of the container and do not enclose a closed portion of the container.

* * * * *

UNITED STATES PATENT AND TRADEMARK OFFICE

CERTIFICATE OF CORRECTION

PATENT NO. : 9,038,851 B2
APPLICATION NO. : 13/050693
DATED : May 26, 2015
INVENTOR(S) : Brad Anthony Picard et al.

It is certified that error appears in the above-identified patent and that said Letters Patent is hereby corrected as shown below:

On the title page, item (73), under "Assignee", line 2, delete "LLL" and insert -- LLC --, therefor.

Signed and Sealed this
Twelfth Day of April, 2016

Michelle K. Lee

Michelle K. Lee
*Director of the United States Patent and Trademark Office*